US006581855B1

(12) United States Patent
Cook

(10) Patent No.: US 6,581,855 B1
(45) Date of Patent: Jun. 24, 2003

(54) WATER MIST COOLING SYSTEM

(75) Inventor: James E. Cook, Anoka, MN (US)

(73) Assignee: Pumptec, Inc., Anoka, MN (US)

( * ) Notice: Subject to any disclaimer, the term of this patent is extended or adjusted under 35 U.S.C. 154(b) by 0 days.

(21) Appl. No.: 09/664,684

(22) Filed: Sep. 19, 2000

(51) Int. Cl.[7] ..... B05B 1/14; A62C 2/08; A62C 37/08

(52) U.S. Cl. ..... 239/550; 239/548; 239/553; 239/554

(58) Field of Search ..... 239/550, 548, 239/553, 554, 556, 557, 558, 562, 566, 542, 567, 266, 207, 104, 106, 112, 113, 124, 126

(56) References Cited

U.S. PATENT DOCUMENTS 2,642,314 A * 6/1953 Dupasquier ..... 239/566
4,182,354 A * 1/1980 Bergstedt ..... 137/10
4,331,179 A * 5/1982 Gray ..... 137/627.5
4,452,397 A * 6/1984 Barton ..... 239/562
4,948,568 A * 8/1990 Chessmore et al. ..... 422/140
5,577,668 A * 11/1996 King et al. ..... 239/558
5,961,047 A * 10/1999 Kleinberger ..... 239/124

* cited by examiner

*Primary Examiner*—Davis Hwu
(74) *Attorney, Agent, or Firm*—Roger W. Jensen

(57) ABSTRACT

A water mist cooling system including a supply of water at a supply outlet. A plurality of misting nozzles are serially connected by hollow tubing means to form a line having two ends. A pump has an inlet connected to the supply outlet, and an outlet connected to a first of two ends of a line of nozzles. The pump is controlled whereby water is pumped by the pump at a preselected pressure through said hollow tubing means to the misting nozzles and thence exiting the nozzles as water mist to the atmosphere. Pressure regulator means is connected to the other of said ends of the line of misting nozzles to provide a line flushing function.

6 Claims, 3 Drawing Sheets

WATER MIST COOLING SYSTEM

BACKGROUND AND FIELD OF THE INVENTION

The present invention relates to a water mist cooling system having a significant advantage over prior art water mist cooling systems.

Water mist cooling systems have been in use for a number of years, and are especially used in areas having a hot, dry climate, e.g., the southwestern United States. Water mist cooling systems are also used in hot, humid areas where such systems are installed on fans to aid evaporation.

Mist cooling or flash evaporative cooling (FEC) is a rapidly growing market. There are a large number of suppliers to this industry, and ease of entry into the business is one of the reasons for said large number of suppliers. Unfortunately (for the customers/users of such systems) the prior art systems have a serious shortcoming, i.e., short duration of effective cooling followed by a requirement for maintenance and repair, as will be explained below. A typical prior art system of the type presently being offered by such suppliers is illustrated in FIG. 1, where tap water flows through an optional pre-filter (for removing suspended solids in the tap water) and thence, optionally, to a pump and a regulator R, and thence to a series of nozzles N connected serially together.

Some of the prior art systems merely operate with tap water pressure, i.e., eliminating the illustrated pump and regulator; these systems are especially unsatisfactory, since tap water pressure is typically relatively low. One problem with tap water pressure type systems is that the relatively low pressure means large droplet size. Instead of evaporating, the large droplets provide a shower effect below the nozzles. Even the systems using a pump, so as to operate at a higher water pressure, are not satisfactory as will be explained.

As indicated above, misting is used in hot, dry areas, and water quality in such arid regions is almost always very poor, i.e., the water has a very high level of total dissolved solids (TDS), usually expressed in parts per million (PPM). The nozzle orifices are very small, e.g., 0.001" to 0.010". Thus, when such prior art systems are used, the high mineral content of the water in the arid regions very rapidly clogs the small misting nozzles. To further explain the problem, during periods of non-use, the high mineral content water leaves a scale similar to that left in a coffee pot. The scale breaks off and becomes the sand which clogs the nozzles. Clogged nozzles have a dual negative effect. First, they do not mist, or mist improperly; and second, by not flowing, they cause excessive backpressure to the pumping system, causing premature pumping system failure. Thus, clogged nozzles disable the entire mist cooling system.

SUMMARY OF THE INVENTION

The present invention provides a mist cooling system wherein a tap water supply is connected to a pump which is adapted, when actuated, to pump the tap water from outlet means thereof at a preselected pressure. The system further comprises a plurality of misting nozzles serially connected by hollow tubing means to form a line having two ends, the first of said two ends being connected to said outlet means of said pump, whereby tap water is pumped by said pump through said hollow tubing means to said misting nozzles and thence through said nozzles as a misting spray to the atmosphere. The pump is controlled whereby tap water is pumped by said pump at a preselected pressure through said hollow tubing means to said misting nozzles and thence exiting said nozzles as tap water mist to the atmosphere to provide the cooling. Finally, and very importantly, the present invention includes a water pressure regulator at the other or second of said ends of the line of misting nozzles. The regulator is set (pressure release setting) at a preselected pressure which takes into account the water pressure in the line produced by the pumping action of the pump so that, at least intermittently, the entire line will be flushed by water exiting the line via the bypass outlet of the regulator valve. Such flushing reduces clogging of the nozzles. Prior art systems may discharge excess fluid at the beginning of a line of nozzles, but that does not flush from the line impurities or contaminates which are thereby trapped in the system.

DETAILED DESCRIPTION OF THE INVENTION

Figure 1:
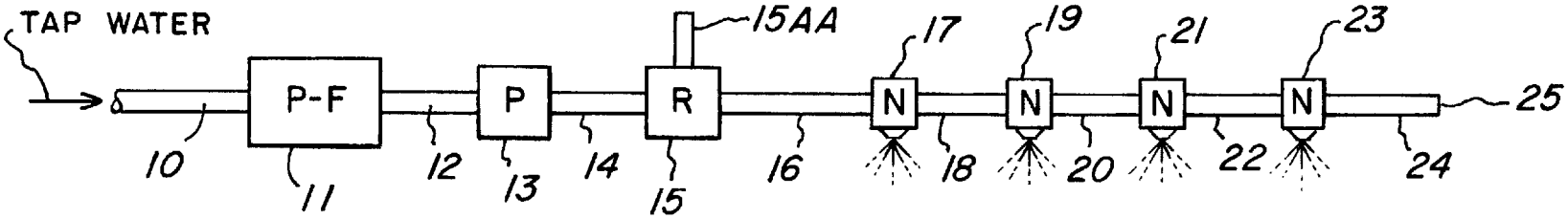
FIG. 1 (PRIOR ART)
FIG. 1 shows a prior art water mist cooling system.

Referring to FIG. 1, the prior art water mist cooling system is shown to include a number of serially connected components, i.e., prefilter 11, pump 13, regulator 15, and nozzles 17, 19, 21, and 23, connected serially together by pipes or tubing 10, 12, 14, 16, 18, 20, 22, and 24, respectively. Tap water is introduced into tubing 10, passes through an optional prefilter 11 and is pumped by pump 13 to or past the regulator 15 to the serially connected nozzles as shown. The regulator 15 is of conventional design, and a bypass 15AA prevents system overpressure in the manner well known to those skilled in the art. The end of the tube 24 is closed off as at 25.

Figure 2:
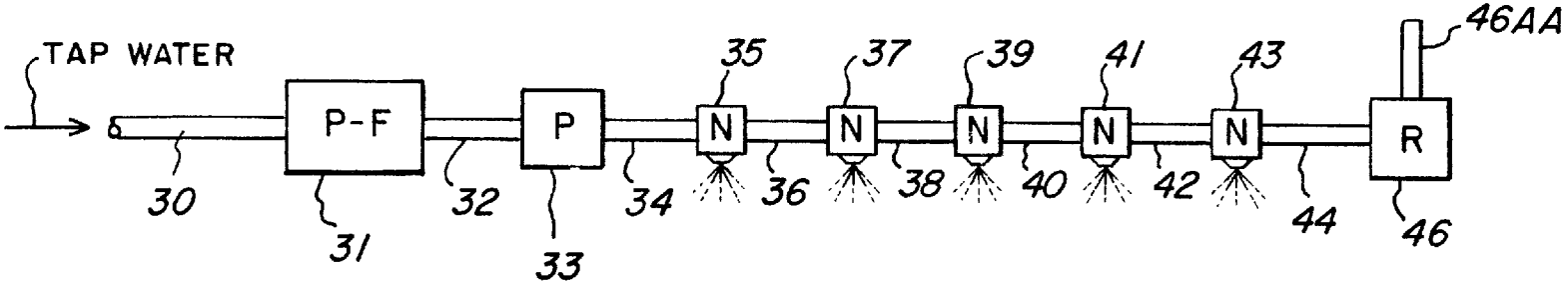
FIG. 2 shows the preferred embodiment of applicant's water mist cooling system invention in schematic form.

The present invention is depicted in a preferred embodiment in FIG. 2, wherein tap water is conducted through tubing 30 to a prefilter 31, the output of which is connected by tubing 32 to the intake of a pump 33. The prefilter 31 is of the well-known commercially available type, and functions to filter out suspended solids in the tap water down to five micron size but, importantly, does not eliminate dissolved minerals in the water. The pump 33 pumps the filtered tap water at a preselected pressure and has an outlet 34 which is connected to a plurality of misting nozzles serially connected by hollow tubing means to form a line having two ends; the first of the two ends being connected to the outlet means 34 of pump.33. More specifically, the plurality of misting nozzles are serially identified by reference numerals 35, 37, 39, 41, and 43. The hollow tubing means connecting said nozzles are respectively identified by reference numerals 36, 38, 40, and 42.

Pump 33 is of the type readily commercially available. One pump that may be used is manufactured by Pumptec, Inc. of Anoka, Minn.; and is shown in applicant's U.S. Pat. No. 5,173,039.

Finally, and very importantly, the present invention includes a water pressure regulator 46 positioned at the other or second of said ends of the line of misting nozzles. The regulator 46 is of conventional design and may be of the type shown in FIG. 3. The regulator is set (pressure release setting) at a preselected pressure which takes into account the water pressure in the line produced by the pumping action of the pump 33 so that, at least intermittently, the entire line will be flushed by water exiting the line via the bypass outlet 46AA of the regulator valve. Such flushing reduces clogging of the nozzles. Prior art systems as shown in FIG. 1 may discharge excess fluid at the beginning of a line of nozzles, but that does not flush impurities or contaminates from the line, which are thereby trapped in the system.

Thus, the basic system as above described provides the above-described extremely important advantage over the prior art system.

Figure 6:
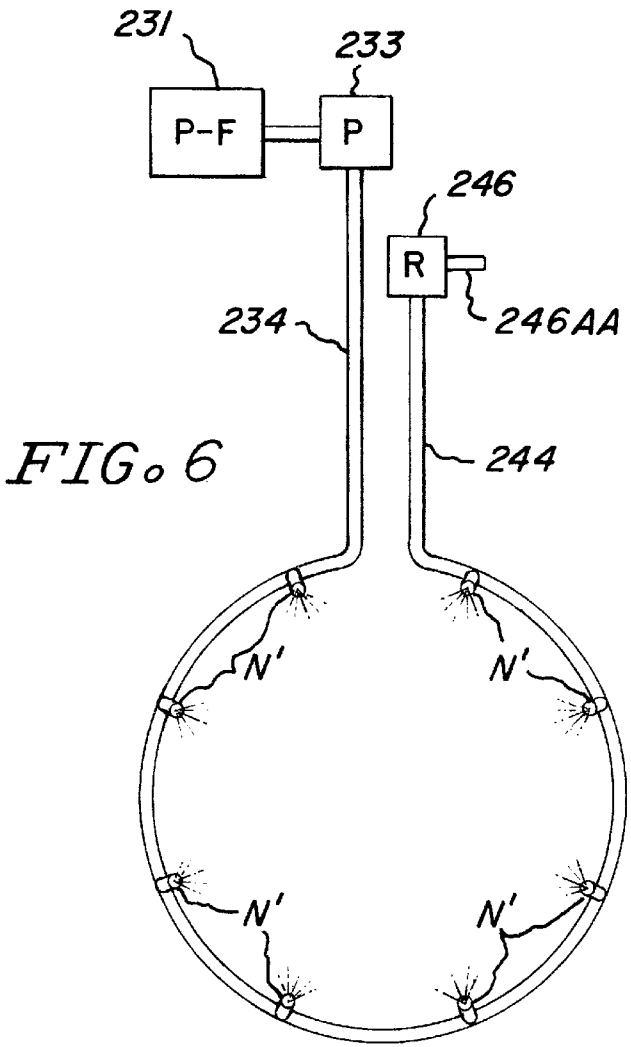
FIGS. 5 and 6 are schematics of other embodiments of applicant's invention.
Figure 5:
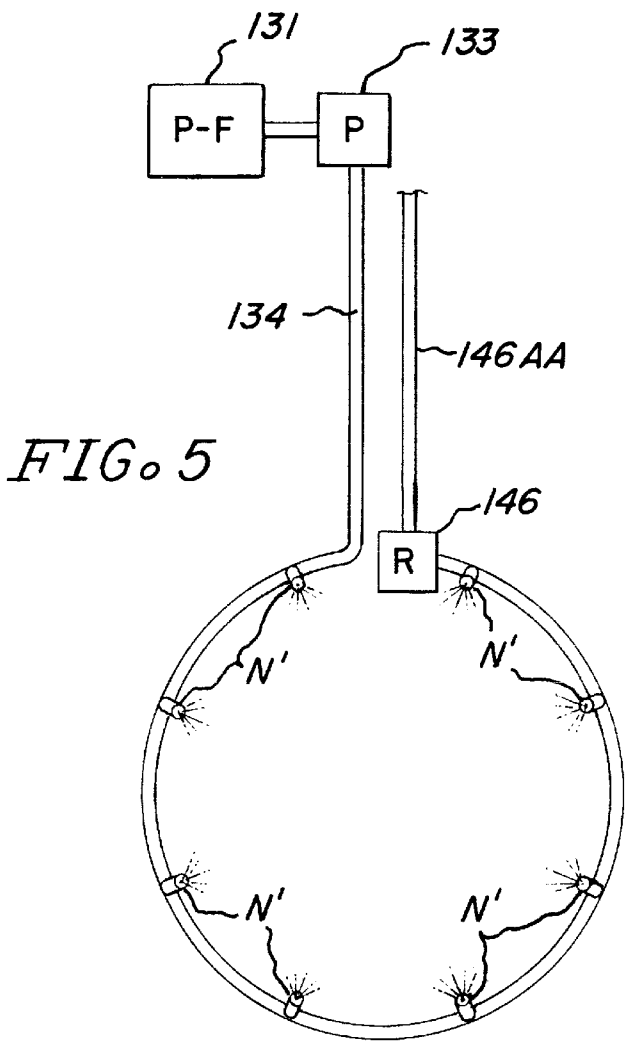

FIGS. 5 and 6 show alternate configurations of the preferred embodiment of applicant's invention. Both figures show a string of nozzles N' arranged coplanarly and in a circle having a preselected diameter. In FIG. 5, prefilter 131, pump 133 and pump outlet means 134 correspond to elements 31, 33, and 34, respectively, of FIG. 2. The nozzles N' form a line, one end of which is connected to pump outlet means 134, and a conventional regulator 146 is connected to the other end. An elongated bypass 146AA diverts bypass flushing water to a more remote location, e.g., near pump 133.

In FIG. 6, elements 231, 233, and 234 correspond to elements 131, 133, and 134 of FIG. 5. A regulator 246 having a bypass 246AA is located somewhat remotely from the circle of nozzles N' but is connected to one end of the circle by tubing 244. As shown in FIG. 6, the regulator is proximate to pump 233. It should be understood that tubing 234 and 244 may have considerable lengths.

Those skilled in the art will recognize that circular configurations of nozzles N1 in FIGS. 5 and 6 are uniquely suitable for misting adjacent to a rotary fan (not shown).

Figure 3:
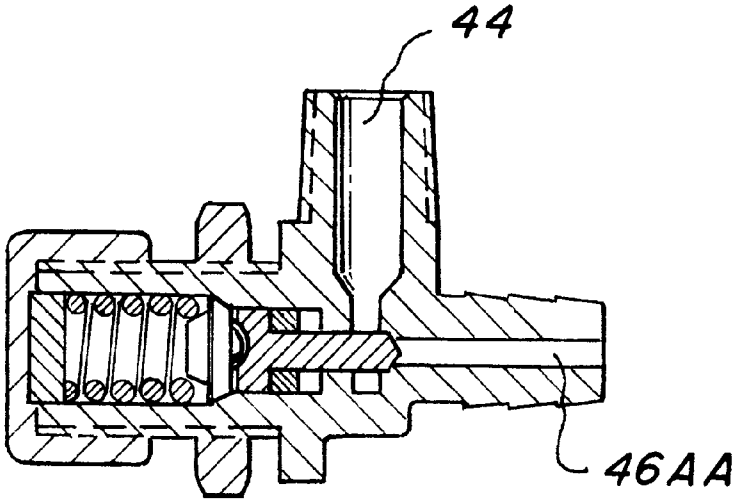
FIG. 3 is a view in cross section of a water pressure regulator.

FIG. 3 shows a regulator which may be used for regulator 46 as shown in FIG. 2. Regulators of this type are readily available in the commercial market. In FIG. 3, reference numerals 44 and 46AA have been used to identify, respectively, the input to and the bypass outlet of the regulator 46 shown in FIG. 2.

Figure 4:
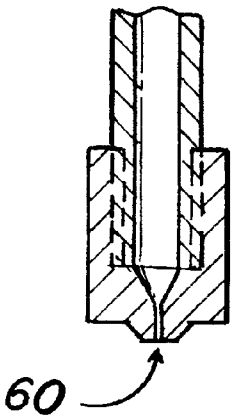
FIG. 4 is a cross sectional view of a nozzle.

FIG. 4, depicting a cross section of a nozzle of the type commercially available and having, as indicated above, a very small orifice 60 which must be very small in diameter in order to provide optimum misting function. As indicated, the orifice ranges between 0.001" and 0.010".

In misting systems, the $H_2O$ or water molecules evaporate. Minerals, e.g., calcium, do not evaporate and are left behind to form fine sand which plugs nozzles. This would be the case of the prior art system shown in FIG. 1. The present system importantly functions to flush the line of nozzles with the flow of flushing water exiting at bypass port 46AA of regulator valve 46. Thus, a significant percentage of the above-noted "sand" is flushed out of bypass 46AA to protect the nozzles from plugging.

While the preferred embodiment of the invention has been illustrated, it will be understood that variations may be made by those skilled in the art without departing from the inventive concept. Accordingly, the invention is to be limited only by the scope of the following claims.

I claim:

1. A water mist cooling system comprising:

a) a water supply having an outlet for supplying water;

b) a pump connected to said outlet and adapted, when actuated, to pump water at a preselected high pressure;

c) a plurality of misting nozzles serially connected by hollow tubing means to form a line having two ends, a first of said ends being connected to receive water pumped by said pump; and d) pressure regulator means connected to the other of said ends of said line of misting nozzles, said system being further characterized by said pressure regulator means including fluid bypass means, and by said pressure regulator means being set at a preselected pressure (regard being given to the pressure in said line) so that, at least intermittently, said line will be flushed by water exiting said line via said bypass means.

2. A water mist cooling system comprising:

a) a water supply having an outlet for supplying water;

b) a pump connected to said outlet and adapted, when actuated, to pump water at a preselected high pressure from outlet means thereof;

c) a plurality of misting nozzles serially connected by hollow tubing means to form a line having two ends, a first of said ends being connected to said outlet means of said pump, whereby water is pumped by said pump through said hollow tubing means to said misting nozzles and thence exiting said nozzles as water mist to the atmosphere; and d) pressure regulator means connected to the other of said ends of said line of misting nozzles, said system being further characterized by said pressure regulator means including fluid bypass means, and by said pressure regulator means being set at a preselected pressure (regard being given to the pressure in said line) so that, at least intermittently, said line will be flushed by water exiting said line via said bypass means.

3. The water mist cooling system of claim 2, wherein said plurality of misting nozzles are arranged in a circle having a preselected diameter.

4. The water mist cooling system of claim 3, wherein said regulator is proximate to said circle and has an elongated bypass tube.

5. The water mist cooling system of claim 3, wherein said regulator is remote from said circle.

6. The water mist cooling system of claim 5, wherein said regulator is proximate to said pump.

* * * * *